United States Patent [19]

Glaser

[11] Patent Number: 4,903,784

[45] Date of Patent: Feb. 27, 1990

[54] IMPACT HAMMER POWER TOOL

[75] Inventor: Donald A. Glaser, Emporia, Kans.

[73] Assignee: Glendo Corporation, Emporia, Kans.

[21] Appl. No.: 252,044

[22] Filed: Sep. 30, 1988

[51] Int. Cl.[4] ..... B25D 9/14

[52] U.S. Cl. ..... 173/116; 173/121; 173/139

[58] Field of Search ..... 173/116, 119, 121, 139; 267/137, 140

[56] References Cited

U.S. PATENT DOCUMENTS 3,393,755 7/1968 Glaser, et al. ..... 173/116

4,694,912 9/1987 Glaser ..... 173/115

*Primary Examiner*—Douglas D. Watts

*Assistant Examiner*—Y. Lin

*Attorney, Agent, or Firm*—Hovey, Williams, Timmons & Collins

[57] ABSTRACT

An impact power tool for use in delicate hand-working operations includes a body presenting a bore and a piston received within the bore and shiftable relative thereto. An impact transmitting member is also received in the bore and is shiftable relative to the body. This impact transmitting member is positioned axially in the bore by a mounting element interposed between the impact transmitting member and the body, the mounting element being resilient relative to the body. The piston is driven along a stroke length between an impact position engaging the impact transmitting member and an extended position out of contact with the member.

17 Claims, 1 Drawing Sheet

IMPACT HAMMER POWER TOOL

BACKGROUND OF THE INVENTION

1. Field of the Invention

The present invention relates generally to impact power tools and, more particularly, to an impact power tool for use in delicate hand-working operations such as those performed by a jeweler.

2. Description of the Prior Art

For centuries, jewelers have employed a hammer and hand-held punch to carry out such tasks as hammering metal around settings, bezel setting, channel setting, prong setting, and bead raising. However, recently, power tools have been developed to assist the jeweler in accomplishing at least some of these arts. For example, U.S. Pat. No. 3,393,755 to Glaser, et al., and U.S. Pat. No. 4,694,912 to Glaser, disclose power tools which may be used for engraving, carving, and delicate stone setting operations. The construction of the devices described in these two patents are incorporated herein by reference so as to obviate the need for further discussion of the types of devices with which the present invention may be employed.

None of the conventional powered devices, such as those discussed above, addresses specifically the problems encountered in hammering operations carried out in the art of jewlery making. For example, there is a need for a powered hammering device that experiences little vibration during use and will not overheat too quickly. In addition, a satisfactory construction must be easily handled and be capable of being accurately positioned prior to activation.

OBJECTS AND SUMMARY OF THE INVENTION

It is an object of the present invention to provide an impact power tool which satisfies these abovementioned needs and which is easy to use.

Further, it is an object of the invention to provide an impact power tool that may be placed in contact with a workpiece prior to operation to ensure that accurate hammering may be carried out.

In accordance with the invention, an impact power tool for use in delicate hand-working operations includes a body presenting a bore and having first and second ends, and a piston received within the bore and shiftable relative to the body. An impact transmitting member, preferably in the form of a punch or chuck, is also received in the bore, at a first end of the body, and is shiftable relative to the body. The impact transmitting member is positioned axially in the bore by means including a mounting element interposed between the impact transmitting member and the body. This mounting element is resilient relative to the body so that the impact transmitting member is resiliently positioned in the bore. Drive means are provided for driving the piston along a stroke length between an impact position engaging the impact transmitting member and an extended position out of contact with the impact transmitting member.

The means for driving the piston may be similar to the means employed to drive the pistons in the above-referenced patents, and several different constructions of the positioning means are possible. For example, the impact transmitting member and the body may each include a hole therethrough, with one of the holes having a diameter smaller than the other, and a pin having a diameter equal to that of the smaller hole may be inserted through the holes with a resilient ring provided between the pin and the wall of the larger hole. In this manner, the impact transmitting member is securely, yet resiliently positioned axially in the bore to permit the punch to move relative to the body when transmitting the force of the piston to the workpiece to be hammered. By this construction, vibration in the tool is greatly reduced and hammering effectiveness is increased.

An impact tip may be included on the tool which is replaceably mounted on the impact transmitting member, e.g. by a set screw or screw-in mounting.

BRIEF DESCRIPTION OF THE DRAWING FIGURES

A preferred embodiment of the invention is discussed below with reference to the drawing, in which.

DETAILED DESCRIPTION OF THE PREFERRED EMBODIMENT

Figure 1:
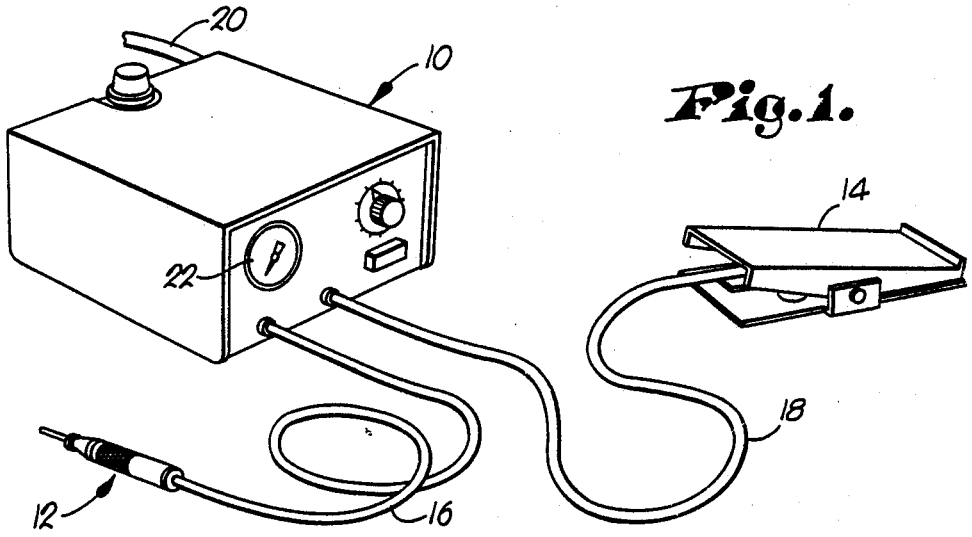
FIG. 1 is a perspective view of an impact tool apparatus in accordance with the invention.

Referring to the drawing, an impact power tool apparatus in accordance with the invention is shown in FIG. 1 to include a control box 10, an impact device 12, and a foot pedal 14. The impact device 12 is connected to the control box by a first conduit 16, and the foot pedal 14 is connected to the control box 10 by another conduit 18. An air compressor or other source of high pressure motive fluid provides motive fluid to the control box via a conduit 10. To operate the apparatus tool, the control box 10 is connected to the source of high pressure motive fluid such as air via a conduit 20 and the fluid is regulated to a suitable pressure by a regulator valve as indicated by a gauge 22 on the front panel of the control box 10. Thereafter, when it is desired to perform a hammering operation, the foot pedal 14 is depressed permitting a controlled amount of motive fluid to cyclically flow to and from the hand-held tool 12 to actuate a hammering action therein.

Figure 2:
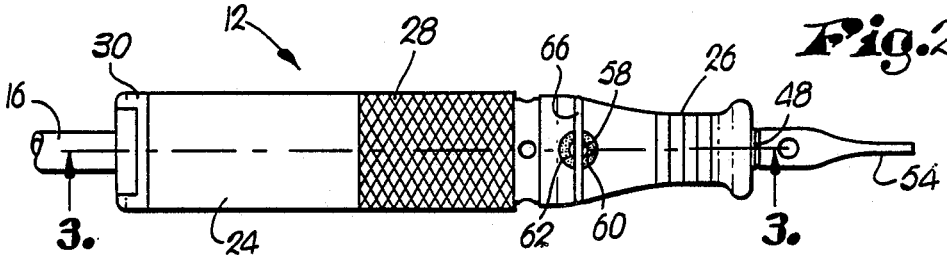
FIG. 2 is a plan view of a hand-held impact tool according to the invention.

The hand-held tool 12 is shown in FIG. 2, and includes a body 24 formed of a user friendly shape having a finger gripping region 26 and a knurled region 28 rearwardly of the finger region 26. The conduit leading to the control box extends from the rear end of the tool which is provided with a closure member 30 that seals the end of the tool to prevent leakage of the fluid from the tool.

Figure 3:
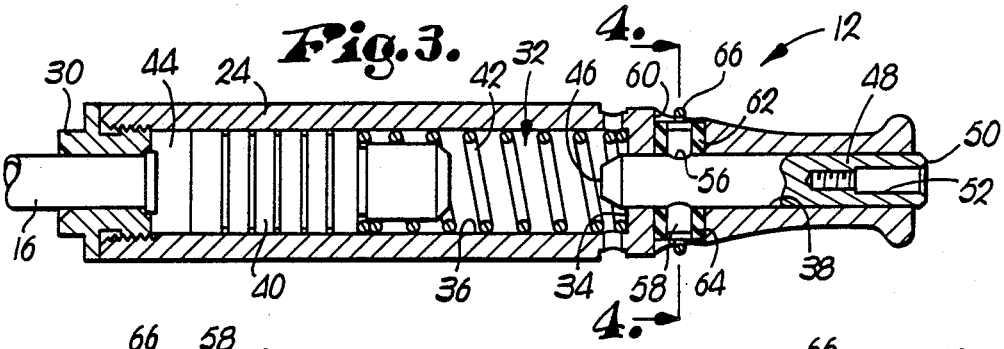
FIG. 3 is a cross-sectional side view of the hand-held tool of FIG. 2, taken along line 3—3 of FIG. 2.

In FIG. 3, the body 24 is illustrated as having a bore 32 extending along the length thereof. The bore is threaded adjacent the rear end of the body, and includes a step 34 between a large diameter portion 36 of the bore and a small diameter portion 38 thereof.

A piston 40 is received in the large diameter portion 36 of the bore and is slidable therein between the closure member 30 and the step 34, and a compression spring 42 positioned in the bore between the piston 40 and the step 34 biases the piston toward the rear end of the tool. A variable space 44 is defined in the bore between the piston 40 and the closure member 30 in which motive fluid is received to force the piston 40 toward the step 34 against the action of the spring 42.

Extending axially into the large diameter portion 36 of the bore beyond the step 34 is an impact receiving end 46 of an impact transmitting member or punch 48 slidably supported in the small diameter portion 38 of the bore. The impact transmitting member or punch 48 includes means for receiving a punch tip at an impact transmitting end 50 thereof, which in the embodiment of FIG. 3 comprises a threaded hole 52 adapted to receive a cooperating threaded tip 54. By providing this structure, it is possible to employ a plurality of different punch tip shapes or to easily replace worn punch tips. Also, a transverse hole 56 extends through the punch 48 and a pin 58 is tightly fitted in the hole 56 with the opposite axial ends of the pin extending beyond the surface of the punch 48 at opposite sides thereof.

Figure 4:
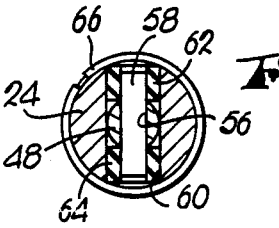
FIG. 4 is a cross-sectional axial view taken along line 4—4 of FIG. 3.

The body 24 is also provided with a transverse hole 60 which extends completely through the body and which communicates with the small diameter portion 38 of the bore 32, as shown in FIG. 4. This body hole 60 has a diameter larger than the diameter of the pin 58 so that an annular space is defined between the pin 58 and the walls of the hole 60 when the pin is coaxially supported in the hole 60. Resilient O-rings or tubular elements 62, 64 of polyurethane having a durometer hardness of about 70 to 85 are provided in the hole 60 at opposite ends thereof to resiliently hold the pin 58 relative to the body 24 in the axial direction of the punch 48 so as to permit the punch to slide in the bore relating to the body 24 when a force is applied on the punch by the piston. If the hardness of the O-rings or tubular elements 62, 64 is too low, a problem results in that the punch 48 is too easily movable in the bore 32 and pressure variations in the large diameter portion 36 of the body cause movement of the punch 48, thus causing difficulty in properly positioning the punch on a workpiece. Alternatively, if the hardness of the elements 62, 64 is too high, the beneficial effect of providing resilience between the punch 48 and the body 24, as discussed herein, is lost.

In addition to providing a resilient connection between the punch 48 and the body 24, the resilient connection also prevents the punch 48 from rotating about its axis within the bore 32. In order to maintain the resilient elements 62, 64 in place in the hole 60, a C-clip 66 or similar means is fitted over the ends of the hole.

Although in the illustrated embodiment of the invention the resilient elements 62, 64 are shown as being received in the oversized body hole 60, it is recognized that an alternative embodiment is possible wherein the transverse hole in the punch is oversized relative to a pin tightly held by the body, and a resilient element is provided in the punch hole between the pin and the walls of the punch. However, in this second embodiment, the punch would have to be made large enough to accommodate the larger diameter hole and less torque would be exerted on the punch through the pin since the pin is connected to the punch through the O-rings or resilient elements and does not define moment arms as in the illustrated embodiment.

In addition, by providing the O-rings or resilient elements 62, 64 in the body 24, the elements 62, 64 are visible to a user and are easily accessible to a person seeking to replace the elements 62, 64. This condition is advantageous since the resilient elements have a tendency to wear to the point that a visible cracking or gapping in the elements 62, 64 may occur. When such wear develops, the cracking or gapping can be visually detected and the O-rings or resilient elements easily replaced.

In use of the illustrated embodiment, when a hammering operation is to be carried out, the tip 54 of the tool 12 is placed in contact with a surface to be hammered and pressure fluid is delivered to the space 44 between the piston 40 and the rear end of the body. This pressure causes the piston 40 to be forced, against the action of the spring 42, toward the punch 48. Depending upon the amount of pressure in the space 44, the piston 40 impacts the end 46 of the punch 48 at a desired speed, thus transferring its momentum to the punch 48. The punch 48 slides axially in the small diameter portion 38 of the bore 32 against the force exerted by the resilient elements 62, 64 to transmit its momentum through the tip 54 to the surface to be hammered.

Figure 5:
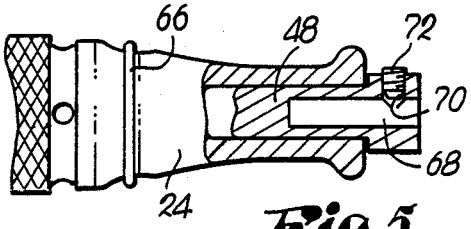
FIG. 5 is a partial side view, taken in cross-section, of a modification of the impact tool according to the invention.

An alternate construction of the tip receiving structure of the punch is illustrated in FIG. 5, and includes an axial bore 68 and a threaded transverse hole 70 in communication with the bore 68. When a tip having a shank is fitted in the bore, a set screw 72 in the hole 70 is tightened to hold the tip in place.

Figure 6:
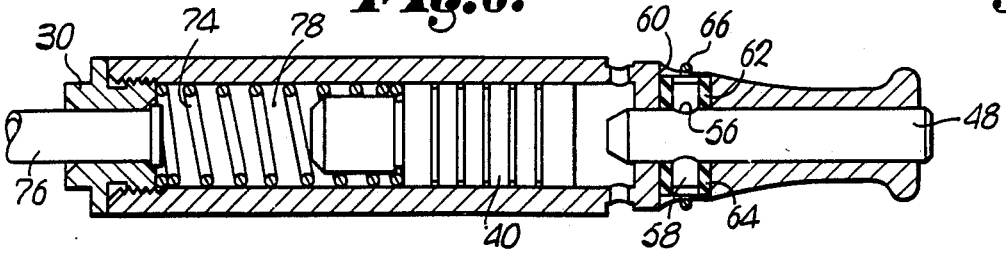
FIG. 6 is a cross-sectional side view of a further modification of the impact tool.

In FIG. 6, a construction is shown which is substantially similar to the previously discussed embodiment, except for the drive means for driving the piston 40 into and out of contact with the punch 48. In the FIG. 6 embodiment, a compression spring 74 is positioned between the piston and the rear end of the body 24 to bias the piston 40 toward the impact transmitting member 48 and the conduit 76 is connected through a suitable control mechanism to a vacuum source. Prior to a hammering operation, the space 78 between the piston 40 and the rear end of the body 24 is evacuated so that the piston 40 is drawn toward the rear end of the body against the action of the spring 74. When a hammering operation is to be carried out, motive fluid is delivered to the space 78 and helps the spring 74 drive the piston 40 into contact with the punch 48.

Although the invention has been described with reference to the preferred embodiments disclosed herein, substitutions and modifications may be made and equivalents employed herein, without departing from the scope of the invention as set forth in the claims.

What is claimed is:

1. An impact power tool for use in delicate handworking operations, the tool comprising:

a body presenting a bore and having a first end and a second end, said bore having a central longitudinal axis;

a piston received within the bore and shiftable relative to the body along the longitudinal axis of the bore;

an impact transmitting member received within the bore at the first end of the body and shiftable relative to the body along the longitudinal axis of the bore;

positioning means for fixing the axial and rotational position the impact transmitting member relative to the bore, the positioning means including a transverse member interposed between the impact transmitting member and the body, the positioning means including first support means for rigidly supporting the transverse member on one of the impact transmitting member and the body, and second support means for resiliently supporting the transverse member for limited axial and rotational movement relative to the other of the impact transmitting member and the body; and drive means for driving the piston along a stroke length between an impact position engaging the impact transmitting member and an extended position out of contact with the impact transmitting member.

2. The impact power tool according to claim 1, wherein the body includes a first hole extending in a direction perpendicular to the bore, and the impact transmitting member, which includes a longitudinal axis, has a second hole extending in a direction perpendicular to the longitudinal axis, one of the first and second holes having a diameter which is smaller than the diameter of the other of the first and second holes, the positioning means including a pin having two axial ends and a diameter substantially equal to the diameter of the one of the first and second holes having a diameter which is smaller than the other, the pin extending into both the first and second holes, and a ring fitted in the other hole, the ring surrounding the pin and being formed of a material which is resilient relative to the pin.

3. The impact power tool according to claim 2, wherein the second hole extends completely through the impact transmitting member and the first hole extends completely through the body, the pin extending through the second hole with the axial ends of the pin projecting into the first hole.

4. The impact power tool according to claim 3, wherein two rings of resilient material are provided, each of which is fitted around said axial end of the pin.

5. The impact power tool according to claim 2, further comprising ring retaining means for retaining the ring in the first hole between the body and the pin.

6. The impact power tool according to claim 5, wherein the ring retaining means includes a band extending around the body and over the first hole.

7. The impact power tool according to claim 1, wherein the drive means includes a spring received in the bore between the first end of the body and the piston, and pressurizing means for selectively pressurizing the volume of the bore between the second end of the body and the piston.

8. The impact power tool according to claim 1, wherein the drive means includes a spring received in the bore between the second end of the body and the piston, and evacuating means for selectively evacuating the volume of the bore between the second end of the body and the piston.

9. The impact power tool according to claim 1, further comprising an impact tip and mounting means for mounting the tip on the impact transmitting member.

10. The impact power tool according to claim 9, wherein the tip screws into the impact transmitting member.

11. The impact power tool according to claim 10, wherein the tip is held on the impact transmitting member by a set screw.

12. An impact power tool for use in delicate handworking operations, the tool comprising:

a body presenting a bore and having a first end and a second end;

a piston received within the bore and shiftable relative to the body;

an impact transmitting member received within the bore at the first end of the body and shiftable relative to the body, the impact transmitting member including a cylindrical impact body having a longitudinal axis, and a positioning arm extending in a direction perpendicular to the longitudinal axis of the impact transmitting member;

positioning means for positioning the impact transmitting member axially in the bore, the positioning means including a mounting element interposed between the arm of the impact transmitting member and the body, the body including a hole in which the arm of the impact transmitting member is received, the hole being oversized relative to the arm in the axial direction of the bore to define a space between the arm and the body on either side of the arm in the axial direction of the bore, the positioning means including at least one resilient element positioned in each space of the hole; and drive means for driving the piston along a stroke length between an impact position engaging the impact transmitting member and an extended position out of contact with the impact transmitting member.

13. The impact power tool according to claim 12, wherein the drive means includes a spring received in the bore between the first end of the body and the piston, and pressurizing means for selectively pressurizing the volume of the bore between the second end of the body and the piston.

14. The impact power tool according to claim 12, wherein the drive means includes a spring received in the bore between the second end of the body and the piston, and evacuating means for selectively evacuating the volume of the bore between the second end of the body and the piston.

15. The impact power tool according to claim 12, futher comprising an impact tip and mounting means for mounting the tip on the impact transmitting member.

16. The impact power tool according to claim 15, wherein the tip screws into the impact transmitting member.

17. The impact power tool according to claim 16, wherein the tip is held on the impact transmitting member by a set screw.

* * * * *